United States Patent [19]

Scumaci

[11] Patent Number: 4,742,630

[45] Date of Patent: May 10, 1988

[54] PARKING METER ADVERTISING DEVICE

[76] Inventor: Francis J. Scumaci, 719 Fernhill Ave., Pittsburgh, Pa. 15226

[21] Appl. No.: 889,496

[22] Filed: Jul. 25, 1986

[51] Int. Cl.[4] ..... G09F 7/18

[52] U.S. Cl. ..... 40/333; 40/607

[58] Field of Search ..... 40/607, 333; 206/485, 206/446; 220/4 B, 4 F; 229/23 BT

[56] References Cited

U.S. PATENT DOCUMENTS

| | | | |
|---|---|---|---|
| 410,387 | 9/1889 | Walsh | 220/4 E |
| 642,507 | 1/1900 | Topping | 220/4 B |
| 1,318,007 | 10/1919 | Gau | 220/4 E |
| 1,581,921 | 4/1926 | Doble | 206/485 |
| 2,065,097 | 12/1936 | Rogers | 40/607 |
| 2,939,236 | 6/1960 | Stein | 40/607 |
| 2,959,339 | 11/1960 | Sierk | 206/485 |
| 3,593,450 | 7/1971 | Mollet | 40/607 |
| 4,217,984 | 8/1980 | Magnuson | 220/4 E |

*Primary Examiner*—Henry E. Raduazo

*Attorney, Agent, or Firm*—Webb, Burden, Robinson & Webb

[57] ABSTRACT

An advertising box which can be attached to a post, such as a parking meter support post, comprises a pair of similarly-shaped, flexible flat panels, each panel including a four-sided center section hingedly connected along respective edges to an upper, lower and pair of side members that fold inwardly about the center section and contact along adjacent edges to form an open-sided, half-box assembly. The upper members, lower members and opposite side members of two-half box assemblies are fastened together with rust-resistant rivets to form a unitary structure about the post. The upper and lower members each include a U-shaped notch formed of a pair of spaced sides and a semicylindrical basin for accomodating a cylindrical post therebetween. The unitary structure is secured to the post with a banding clamp; two mounting brackets positioned about 180° apart on the clamp; and a pair of bolts having security heads and sized to fit within threaded apertures in the mounting brackets.

20 Claims, 3 Drawing Sheets

PARKING METER ADVERTISING DEVICE

FIELD OF THE INVENTION

This invention relates to the field of display or advertising devices and, more particularly, to an advertising box which can be attached to a post such as a cylindrical parking meter support post.

BACKGROUND OF THE INVENTION

The use of parking meters for outdoor display and advertising purposes is well recognized. Because of their mass number, frequent use and high visibility in given metropolitan areas, parking meters support posts are a fairly inexpensive means by which to advertise new or existing products, services or the like.

U.S. Pat. No. 4,453,325 is exemplary of one of several means by which to advertise directly on the body of an individual parking meter. Advertising decals are affixed to a miniature billboard mounted on the replaceable meter cap strap of the meter body above the timing indicator. Most often, though, municipalities, parking authorities and private lot owners do not own the meters attached to a meter support post. Where title remains with the meter manufacturer, express authorization from the owner is required before the meter bodies may be removed, replaced, handled or otherwise altered. Meter owners may not condone advertisements on their property absent some royalty agreement.

It is also known to attach display or advertising devices to elongated, vertical posts such as cylindrical parking meter support posts. Attachment directly to the posts does not require express authority from the owners of the meter bodies in most instances, however. Only permission from the municipal authorities is required.

In U.S. Pat. No. 2,468,421, a one-piece, transparent advertising case was disclosed for attachment to parking meter support posts. The hollow, plastic case was weatherproof and tamperproof, but it was also cumbersome to store, transport and install. Because of its rectangular, one-piece construction, the advertising case of this patent required the individual meter bodies be removed for installation purposes.

Three-sided meter post displays were disclosed in U.S. Pat. Nos. 2,372,387 and 2,616,196. Both patents teach mounting procedures by which to discourage tampering by unauthorized persons. By their construction, however, these advertising devices would also be awkward to transport from post to post during installation. The two box-shaped members which comprise the advertising devices of U.S. Pat. Nos. 2,507,875 and 2,759,281 would also be difficult to store and carry about. Although these devices mount easily to existing meter support poles, the size and rigidness of the component parts of the box-shaped members preclude their being easily stored or carried. This same disadvantage is found with other information boxes or display devices that attach to posts other than parking meter supports. In U.S. Pat. Nos. 3,986,284 and 4,300,299, complicated box-like displays are disclosed which are difficult to assemble and very space consuming because of the specially molded members which comprise each device therein.

It is therefore an object of the present invention to provide an inexpensive, yet durable and tamperproof advertising box which stores and transports easily for installation. The advertising box of the present invention assembles quickly and easily about existing parking meter support posts. Depending upon the shape of the support post, additional securement means may not be required.

It is a further object of the invention to provide an advertising box to which multiple advertising labels may be fixedly attached. Should a section of the present invention become overloaded with advertising labels from expired contracts, the box may be disassembled, inverted and reassembled about the same meter support post for continued use.

SUMMARY OF THE INVENTION

An advertising box for attachment to a post according to the present invention comprises a pair of similarly-shaped, flexible flat panels, each panel including a four-sided center section hingedly connected along a top edge to an upper member, along a bottom edge to a lower member and along each side edge to a side member. The upper, lower and side members of each flat panel fold inwardly about the center section until the members contact along adjacent edges to form an open-sided, half-box assembly. The invention further comprises means for fastening together the upper members, lower members and opposite side members of two half-box assemblies to form a unitary structure about the post with means on the upper and lower members for accommodating the shape of a post, such as a cylindrical parking meter support post, therebetween.

Preferably, the flexible flat panels which form the half-box assemblies of the invention are made from sheets of a high density polyethylene. Each polyethylene sheet has prescored fold lines which define the center section and hingedly connect the same to the upper, lower and side members, whereby the center section is integrally formed with the upper, lower and side members of each flat panel. The center section of the invention is suitable for receiving an advertising label fixedly attached thereto. Most preferably, the center section is shaped as a trapezoid.

The fastening means of the preferred embodiment include a plurality of rivets. Most preferably, aluminum rivets extend through a plurality of apertures in the upper, lower and side members which correspondingly align when two half-box assemblies are overlapped to form the unitary structure of the invention.

The means for accommodating a cylindrical post comprises a U-shaped notch including a pair of spaced sides and a semicylindrical basin, said notch extending inwardly from the edges of the upper and lower members opposite the center section. In an alternative embodiment, the notches of the upper and lower members each have a semicylindrical basin with a diameter equal to that of the cylindrical post while the notch sides are spaced apart a distance slightly larger than the diameter of the post.

The advertising box of the present invention further includes means for securing the unitary structure to an elongated, vertical post such as a cylindrical parking meter support post. Specifically, the securement means comprises a banding clamp having a length greater than the circumference of the post which it surrounds; a pair of mounting brackets positioned about 180° apart on the banding clamp; and a plurality of bolts having security heads and sized to fit within threaded apertures in the mounting brackets.

With the foregoing arrangement, a flexible, lightweight, weather and tamper-resistant advertising box can be easily stored, transported and assembled at an installation site. Advertising boxes, according to the present invention, are also sturdy, invertible for reuse and inexpensive to manufacture.

DETAILED DESCRIPTION OF THE PREFERRED EMBODIMENTS

Figure 1:
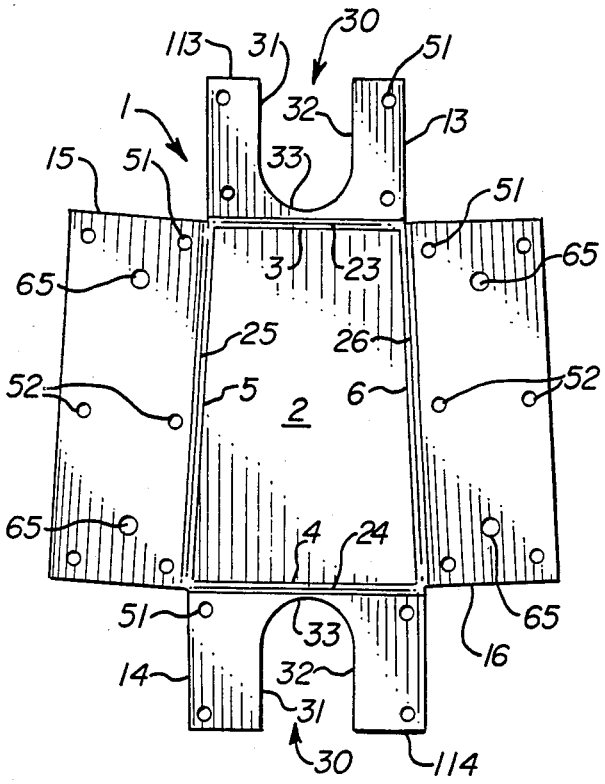
FIG. 1 is a plan view of a flexible, flat panel according to the present invention.

Referring to FIG. 1, a flexible, flat panel 1 according to the present invention is shown. The panel 1, preferably made from sheets of a high density polyethylene, includes a center section 2 having a top edge 3, bottom edge 4 and two side edges 5, 6. Along top edge 3, center section 2 hingedly connects to upper member 13. Along bottom edge 4, center section 2 hingedly connects to lower member 14. The side edges 5, 6 of center section 2 also hingedly connect to side members 15, 16, respectively. As illustrated in FIG. 1, flat panel 1 also includes a plurality of prescored fold lines 23, 24, 25 and 26, which define center section 2 and hingedly connect the same to the upper 13, lower 14 and side members 15, 16. With the above arrangement of flat panel 1 and prescored fold lines 23–26, the center section 2 is preferably integrally formed with upper member 13, lower member 14 and side members 15, 16.

Figure 2:
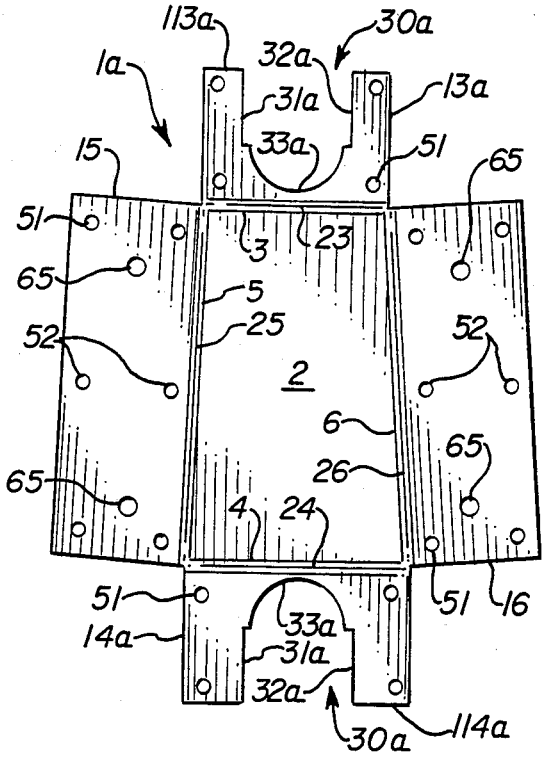
FIG. 2 is a plan view of an alternative embodiment of the flat panel according to the present invention.

An alternative embodiment of flat panel is shown in FIG. 2. Like the earlier described version, flat panel 1*a* includes a four-sided center section 2 hingedly connected along respective edges 3–6 to an upper member 13*a*, lower member 14*a* and two side members 15, 16. The side members 15, 16 are identical with those of the earlier version; the upper and lower members are designed differently, however, because of the differently shaped accommodating means thereon as will be described hereinafter.

In FIG. 1, the accommodating means on both upper and lower members 13, 14 comprise a U-shaped notch, generally 30, which includes a pair of spaced sides 31, 32 and a semicylindrical basin 33. Notch 30 extends inwardly from edge 113 of upper member 13 and from edge 114 of lower member 14 towards the center section 2. Both edges 113, 14 are opposite the edges 3 and 4, respectively, which are connected to center section 2. Sides 31, 32 of notch 30 may be spaced uniformly apart (as shown) or may taper inwardly to basin 33, provided that the basin is sized to accommodate half of a cylindrical post or the like.

In the alternative embodiment (FIG. 2), there is also shown a U-shaped notch 30*a* extending inwardly from edges 113*a*, 114*a* of upper member 13*a* and lower member 14*a*, respectively. However, the sides 31*a*, 32*a* of notch 30*a* are spaced apart a distance larger than the diameter of a cylidnrical post which the sides surround during installation. Semicylindrical basin 33*a* of notch 30*a* has a diameter equal to the diameter of the same cylindrical post (not shown). This arrangement insures easier installation of the half-box assemblies by proving ample post clearance between sides 31*a*, 32*a* while assuring the tight fit of the post against basin 33*a*. As shown in FIG. 2, the sides 31*a*, 32*a* of notch 30*a* are spaced uniformly apart. Alternatively, the sides may be variably spaced to taper inwardly to basin 33*a*.

Figure 3:
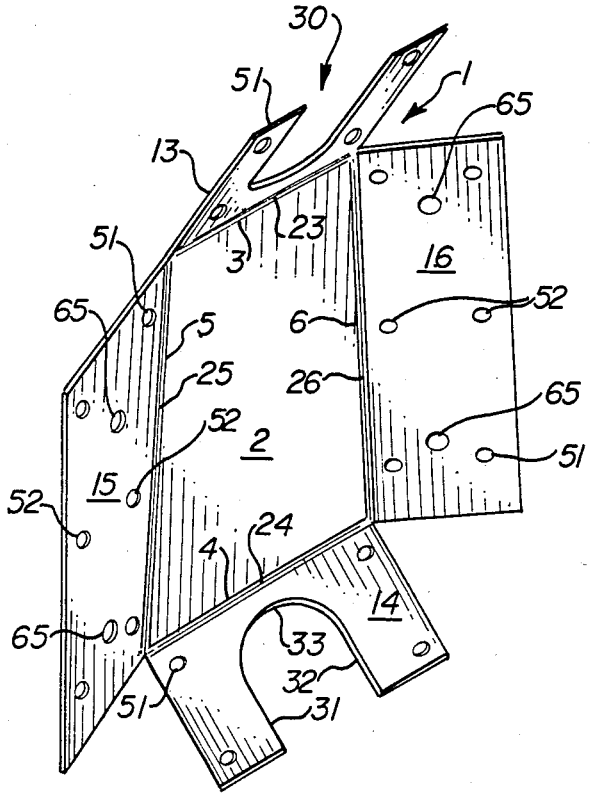
FIG. 3 is a perspective view of the flat panel of FIG. 1 with the upper, lower and side members partially folded about the center section.
Figure 4:
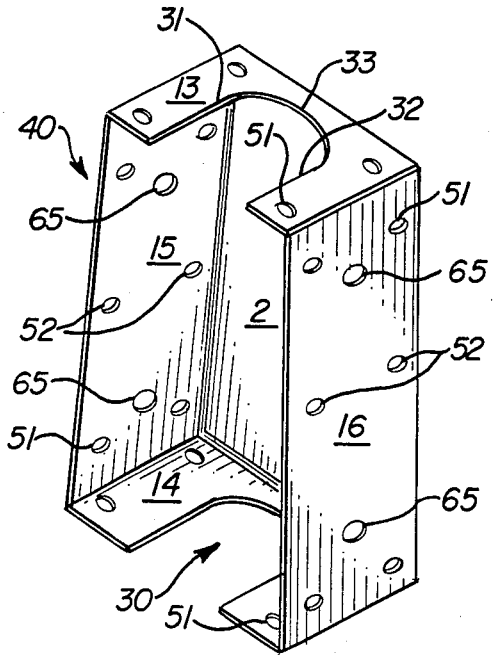
FIG. 4 is a perspective view of a half-box assembly according to the invention.

As best seen in FIGS. 3 and 4, the flexible, flat panels of the invention are arranged to have an upper member 13, lower member 14 and both side members 15, 16 fold inwardly about center section 2. When completely folded together (FIG. 4), adjacent edges of the upper, lower and side members contact to form an open sided half-box assembly, generally identified by reference number 40. Since the prescored fold lines 23–26 defining center section 2 allow for folding of the upper, lower and side members in either direction about center section 2, a second half-box assembly may be later formed from the same flat panel 1 by merely inverting the upper, lower and side members to expose a new exterior portion of center section 2. This is most beneficial where previously used center sections become so cluttered with the labels from expired advertising contracts as to necessitate inversion of the half-box assemblies.

Figure 5:
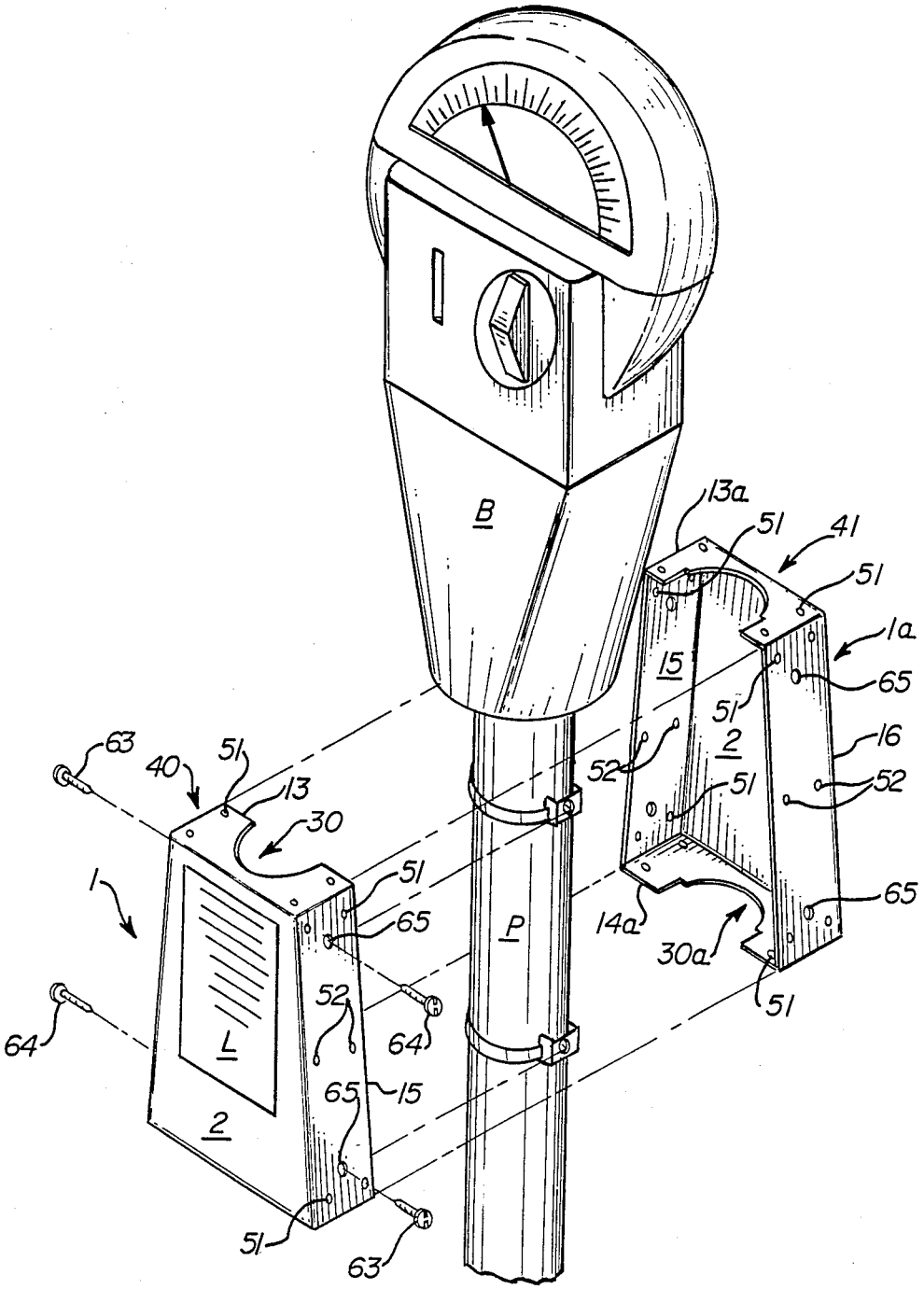
FIG. 5 is a perspective view of the mounting of a unitary structure about a cylindrical parking meter support post.
Figure 6:
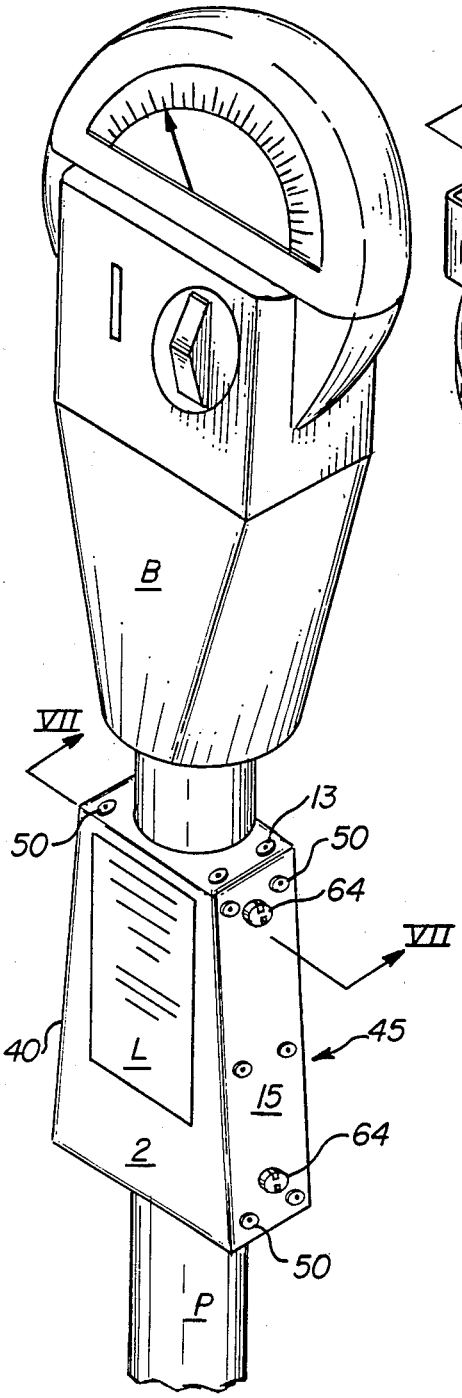
FIG. 6 is a perspective view of an advertising box mounted on a parking meter support post.
Figure 7:
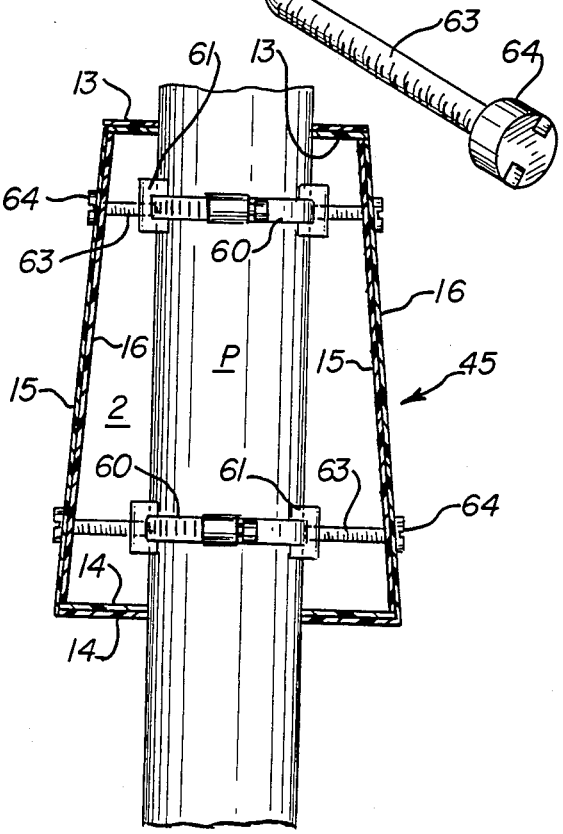
FIG. 7 is a section of FIG. 6 taken along lines VII—VII in FIG. 6 and below the parking meter body.

In order to assemble the advertising box as shown in FIGS. 5–7, the upper members, lower members and opposite side members of two half-box assemblies 40, 41 are overlapped and fastened together to form a unitary structure 45 about elongated, vertical post P directly beneath parking meter body B. Since assembly 40 overlaps assembly 40 as shown, the center panel of assembly 40 will be taller and wider than the center panel of assembly 41 by two thicknesses of the panel material. The unitary structure 45 need not be formed from two similar half-box assemblies, however. For illustrative purposes, unitary structure 45 shown in FIG. 6 comprises half-box assembly 40 formed from flat panel 1 of the first embodiment (FIG. 1) and joined to half-box assembly 41 formed from flat panel 1a of the second embodiment (FIG. 2).

Unitary structure 45 may be mounted on any area of a post such as a cylindrical parking meter post P. However, securement of structure 45 to post P directly beneath meter body B achieves maximum public exposure to the product or service advertised on the label L affixed to the center section 2 of half-box assembly 40. At least one label L is fixedly attached to each half-box assembly. This label may be affixed prior to or following assembly of unitary structure 45 about post P. Labels may also be arranged over previously affixed labels once the earlier advertising contracts expire. For a more professional and customized appearance, label L is affixed to a center section 2 shaped as a trapezoid. In addition, the advertising material may be silk screened or painted onto the flat panels prior to installation.

Preferably, the half-box assemblies of FIGS. 4–5 are fastened together with a plurality of rivets 50 made from aluminum or other rust-resistant materials. Half-box assemblies may also be joined together by heat welding, adhesives, staples, tongue and groove edges or any other suitable means. To facilitate rivet connections, the upper, lower and side members of each flat panel have a plurality of apertures through which the rivets 50 extend. As shown in FIGS. 1–6, upper members 13, 13*a* and lower members 14, 14*a* each contain four rivet apertures 51 nearest the corners of each member. In addition to corner apertures 51, side members 15, 16 each include a pair of apertures 52 along each edge and intermediate apertures 51. Both corner apertures 51 and intermediate apertures 52 of the upper, lower and side members are positioned to correspondingly align when two half-box assemblies are overlapped to form unitary structure 45 about post P. Alternatively, each side member may include only three rivet apertures extending through an imaginery plane intermediate the edges of the side member. A plurality of apertures may also extend through specific left-handed half-box assemblies and right-handed half-box assemblies such that the apertures align only when the two assemblies are completely overlapped to form unitary structure 45.

Figure 8:
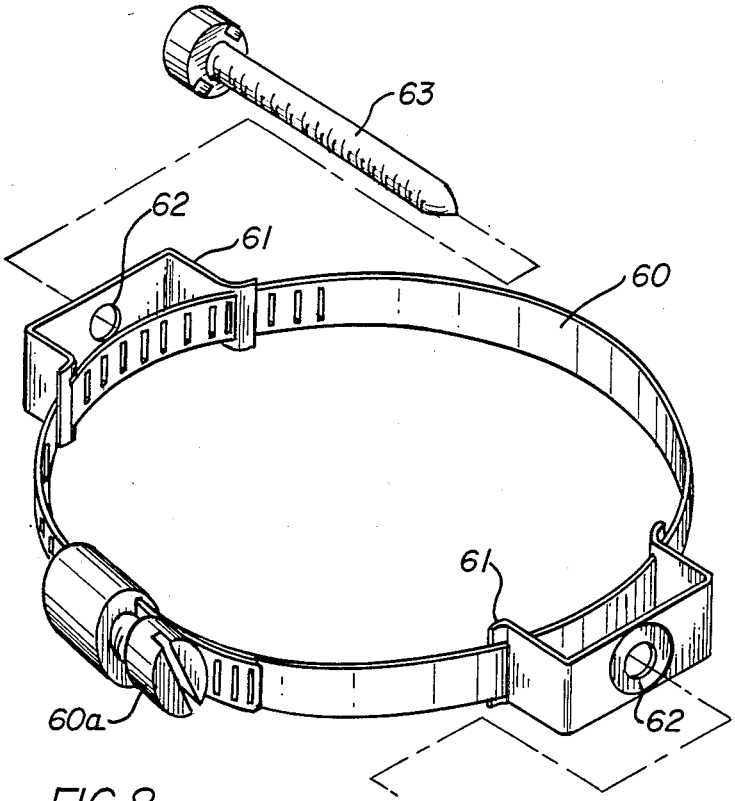
FIG. 8 is a perspective view of the securement means of the preferred embodiment.

The advertising box may be mounted directly on an elongated, vertical post having a variable diameter which either tapers upwardly or downwardly to a maximum. With cylindrical posts of this sort, the unitary structure need only be assembled about a thinner portion of the post, then forced downwardly until the diameter of the post exceeds the diameter of the U-shaped notches in either the upper or lower members.

Where the meter post to which the advertising box herein attaches is cylindrically uniform in diameter or if more secure attachment is desired, a means for securing unitary structure 45 about post P may be used. As shown in FIGS. 7–8, the securement means preferably comprises a rust-resistant airplane or banding clamp 60 having a total length greater than the circumference of the cylindrical post and securely mounted to the post P. A pair of mounting brackets 61 are positioned about 180° apart on clamp 60 by tightening screw 60*a*, each mounting bracket having at least one threaded aperture 62 extending therethrough. Each aperture 62 receives a correspondingly sized, rust-resistant bolt 63 having a security head 64 thereon. Any known pattern for the security head 64 of bolt 63 will suffice provided that tampering and unauthorized removal of the boxes from respective meter posts are discouraged. For greater ease in securing unitary structure 45 about post P, each side member 15, 16 has at least one aperture 65 through which bolt 63 extends. As shown in FIGS. 1–5, each side member preferably includes two apertures 65 through which the bolts of two securement means extend. Like the smaller rivet apertures 51, 52, bolt apertures 65 correspondingly align when the half-box assemblies are overlapped to form unitary structure 45.

Having described the presently preferred embodiments of the invention, it is to be understood that it may be otherwise embodied within the scope of the following claims.

I claim:

1. An advertising box adapted to be attached to a post, said advertising box comprising:

a pair of similarly-shaped, flexible flat panels, each panel including a four-sided center section hingedly connected along a top edge to an upper member, along a bottom edge to a lower member and along each side edge to a side member, wherein said upper, lower and side members are foldable inwardly about said center section and contact along adjacent edges to form an open-sided, half-box assembly;

means for fastening together said upper members, said lower members and opposite side members of two half-box assemblies to form a unitary structure about said post; and means on said upper and lower members for accommodating the shape of said post therebetween.

2. The advertising box of claim 1 wherein said panels are made from sheets of a high density polyethylene.

3. The advertising box of claim 2 wherein each flat panel has prescored fold lines which define said center section and hingedly connect said center section to said upper, lower and side members, and said center section is integrally formed with said upper, lower and side members.

4. The advertising box of claim 1 further including at least one advertising label attached to said center section.

5. The advertising box of claim 1 wherein said center section is formed in the shape of a trapezoid.

6. The advertising box of claim 1 wherein said fastening means includes a plurality of rivets and said upper, lower and side members have a plurality of apertures through which said rivets extend, whereby said apertures correspondingly align when said upper, lower and opposite side members of two half-box assemblies are overlapped to form said unitary structure.

7. The advertising box of claim 1 wherein said post is a cylindrically shaped post and said accommodating means comprises a U-shaped notch, including a pair of spaced sides and a semicylindrical basin, said notch extending inwardly from an edge of said upper and lower members opposite said center section.

8. The advertising box of claim 7 wherein said semicyindrical basin has a diameter equal to the diameter of said post and said sides are spaced apart a distance larger than the diameter of said post.

9. The advertising box of claim 1 further including means for securing said unitary structure to said post.

10. An advertising box which is attached to an elongated, vertical post, said advertising box comprising:

a pair of similarly-shaped, flexible flat panels, each panel including a four-sided center section hingedly connected along a top edge to an upper member, along a bottom edge to a lower member and along each side edge to a side member, with said upper lower and side members folded inwardly about said center section until adjacent edges contact to form an open-sided, halfbox assembly;

means for fastening together said upper members, said lower members and opposite side members of two half-box assemblies to form a unitary structure about said post;

means on said upper and lower members for accommodating the shape of said post therebetween; and means for securing said unitary structure to said post.

11. The advertising box of claim 10 wherein said panels are made from sheets of a high density polyethylene.

12. The advertising box of claim 11 wherein each flat panel has prescored fold lines which define said center section and hingedly connect said center section to said upper, lower and side members, and said center section is integrally formed with said upper, lower and side members.

13. The advertising box of claim 10 wherein at least one advertising label is attached to said center section.

14. The advertising box of claim 10 wherein said center section is trapezoidal in shape.

15. The advertising box of claim 10 wherein said fastening means includes a plurality of rivets and said upper, lower and side members have a plurality of apertures through which said rivets extend, whereby said apertures correspondingly align when said upper, lower and opposite side members of two half-box assemblies are overlapped to form said unitary structure.

16. The advertising box of claim 9 wherein said post is cylindrically shaped and said accommodating means comprises a U-shaped notch, including a pair of spaced sides and a semicylindrical basin, said notch extending inwardly from an edge of said upper and lower members opposite said center section to said center section.

17. The advertising box of claim 16 wherein said semicylindrical basin has a diameter equal to the diameter of said cylindrical post and said sides are spaced apart a distance larger than the diameter of said cylindrical post.

18. The advertising box of claim 17 wherein said sides of said notch are spaced uniformly apart.

19. The advertising box of claim 10 wherein said securing means includes:

a banding clamp surrounding and attached to said cylindrical post;

a pair of mounting brackets positioned about 180° apart on said banding clamp, each mounting bracket having at least oine threaded aperture extending therethrough; and a plurality of bolts, each bolt having a security head and sized to fit within said threaded apertures in said mounting brackets.

20. An advertising box which is attached to an elongated, vertical post, said advertising box comprising:

a pair of similarly-shaped, flexible flat panels, each panel including a four-sided center section hingedly connected along a top edge to an upper member, along a bottom edge to a lower member and along each side edge to a side member, with said upper, lower and side members folded inwardly about said center section until adjacent edges contact to form an open-sided, half-box assembly;

means for fastening together said upper members, said lower members and opposite side members of two half-box assemblies to form a unitary structure about said post;

means on said upper and lower members for accommodating the shape of said post therebetween; and means for securing said unitary structure to said post, said securing means including a banding clamp surrounding and attached to said cylindrical post, a pair of mounting brackets positioned about 180° apart on said banding clamp, each mounting bracket having at least one threaded aperture extended therethrough, and a plurality of bolts, each bolt having a security head and sized to fit within said threaded apertures in said mounting brackets, with each side member having at least one aperture through which said bolts of said securing means extend.

* * * * *